United States Patent [19]
Georgel
[11] Patent Number: 4,484,198
[45] Date of Patent: Nov. 20, 1984

[54] ANTENNA SUPPORT SYSTEM WITH TWO DIMENSION FLEXIBILITY

[75] Inventor: Jean Georgel, Paris, France

[73] Assignee: Thomson-CSF, Paris, France

[21] Appl. No.: 363,390

[22] Filed: Mar. 29, 1982

[30] Foreign Application Priority Data

Apr. 3, 1981 [FR] France ..... 81 06768

[51] Int. Cl.[3] ..... H01Q 15/16
[52] U.S. Cl. ..... 343/880; 343/915
[58] Field of Search ..... 343/880, 915, 912, 914, 343/840

[56] References Cited

U.S. PATENT DOCUMENTS 3,694,059 9/1972 Shakespeare ..... 343/912

FOREIGN PATENT DOCUMENTS 913 8/1978 European Pat. Off. .
1187003 2/1965 Fed. Rep. of Germany .
2215977 4/1972 Fed. Rep. of Germany .
2227563 6/1972 Fed. Rep. of Germany .
2738597 1/1979 Fed. Rep. of Germany .
1354295 3/1963 France .
2349011 4/1976 France .
2415271 1/1979 France .
1382094 1/1975 United Kingdom ..... 343/915

*Primary Examiner*—Eli Lieberman
*Assistant Examiner*—K. Ohralik
*Attorney, Agent, or Firm*—Cushman, Darby and Cushman

[57] ABSTRACT

Ultra-high frequency antenna comprising a mirror constituted by a casing, whereof one face is metallized, and a support constituted by a metallic lattice, with connecting members fixing the mirror to its support. As the expansion coefficients of the mirror and the support differ, to prevent deformation of the latter, a connecting member located at the reference point which, for a revolution structure coincides with the apex, is rigid in all directions, whereas the other connecting members are semi-rigid, ensuring a certain flexibility in the expansion direction of the considered fixing points.

Application to the antennas of radar, telecommunications and space telecommunications systems.

11 Claims, 10 Drawing Figures

ANTENNA SUPPORT SYSTEM WITH TWO DIMENSION FLEXIBILITY

BACKGROUND OF THE INVENTION

Antennas constituted by a shell or casing, whereof one face called the mirror acts as a radiating or reflecting surface and a rigid structure producing the general shape of the mirror are widely used in various technologies using transmission by electromagnetic waves, such as for example in telecommunications, radar systems, etc.

With a view to facilitating the installation of such antennas and for reducing their cost, it is conventional practice to make the casing from a plastic material, which is optionally filled and generally has a honeycomb structure, the mirror surface being metallized. The mirror is fixed to the rigid support by screwed or adhered fastenings, in order to guarantee a rigid connection between the mirror and its support, thereby ensuring the overall rigidity of the latter. Thus, it is known that the performance characteristics of the antenna are largely determined by the surface of the mirror. With very small tolerances, it must be able to reproduce the theoretical surface defined by the sought characteristics of the antenna. On the basis of this objective, it is standard practice to fix the casing rigidly to its support.

In the design of radar antenna reflectors, it is conventional practice for the front structure forming the reflecting mirror to be constituted by a sandwich panel having a resin glass skin, whilst the rear support is constituted by a different structure, in the form of lattices or gratings of tubes, or shaped metal sections or sheet steel or aluminium boxes or panels.

These two structures are generally connected by rigid screwed or adhered fastenings.

The expansions of the front and rear structures are never strictly the same either because, as a result of insolation the temperature of the front, opaque, insulating face differs from that of the rear structure or because, even in the case of identical temperatures, the expansion coefficients of aluminium, steel and resin glass laminates are not the same.

Under the influence of these expansions, stresses occur at the connecting members between the front and rear structures, which lead to deformations of the mirror prejudicial to the satisfactory operation of the radar particularly when the sought radio performances require very strict mirror shape characteristics.

BRIEF SUMMARY OF THE INVENTION

According to the invention, the connecting members are influenced in such a way that the stresses resulting from thermal expansions are either zero or negligible and as a result the mirror is not subject to deformation.

The present invention therefore relates to an ultra-high frequency aerial comprising a mirror and a support having different expansion coefficients and joined to one another by connecting members, wherein one of the connecting members, positioned at the reference point of the mirror is rigid in all directions, whilst the other connecting members are rigid in a first direction coinciding with the perpendicular to the mirror at the fixing point in question and flexible in at least one second direction, which is perpendicular to the first, in the relative expansion direction at this point of the mirror with respect to the support.

The essential advantage resulting from the use of semi-rigid connecting elements and which comply with the conditions referred to hereinbefore is that they provide a clearly defined, rigid overall connection between the casing and its support, whilst still permitting a free expansion of the mirror relative to the support. In this way, it is possible to prevent any deformation of the mirror resulting from stresses, due to temperature variations in operation. Thus, the rigidity along the line perpendicular to the surface and rigid fastening at a reference point ensure that a geometrical shape of the surface is maintained. Flexibility in at least one direction tangential to the surface permits an expansion of the surface, in the mathematical sense of the term, without causing deformation of said surface and in this way preventing any radio interference.

BRIEF DESCRIPTION OF THE DRAWINGS

The invention is described in greater detail hereinafter relative to non-limitative embodiments and the attached drawings, wherein show.

DETAILED DESCRIPTION OF THE PREFERRED EMBODIMENTS

In the introduction to the present specification, the object of the present invention is described, this being obviating deformations generally due to an expansion difference between the mirror and the support under the action of heating in the case of an antenna. It has been stated that at least one of the connecting members between the mirror and the support is completely rigid, namely that located at the reference point of the mirror surface. To define the reference point, it is possible to envisage two classes of antenna structures covered by the invention, namely revolution structures and structures having a plane of symmetry. In the case of a revolution structure, the reference point coincides with the apex of the mirror, whereas in the case of a structure with a plane of symmetry, the reference point is that, located in the plane of symmetry, at the apex of the section in the mirror intersected by this plane of symmetry. Thus, this point is not necessarily the centre of the mirror surface.

Figure 1:
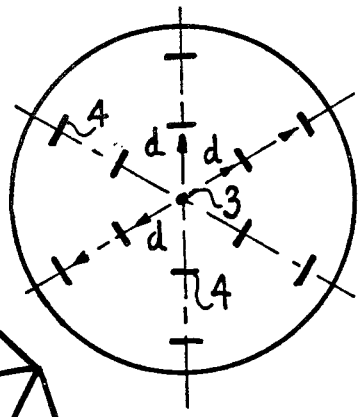
FIG. 1 rotational antenna structure according to the invention viewed from the front (a) and a profile view in two variants (b) and (c).
Figure 1:
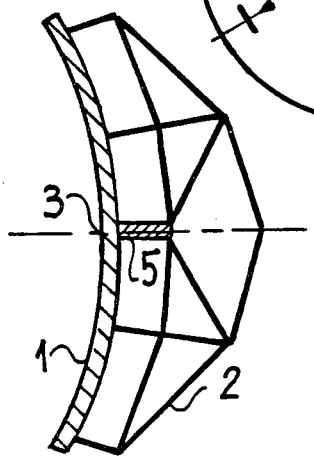

FIG. 1 shows a revolution antenna structure, viewed from the front in 1*a* and in profile view in 1*b* and 1*c*, in two different variants.

Figure 1C:
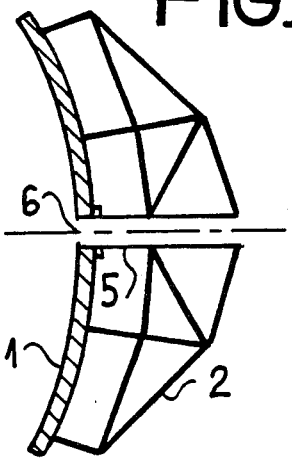

In the drawing, it is possible to see the shell or casing 1, whereof one of the faces, namely that turned towards the left in FIGS. 1*b* and 1*c*, is metallized and constitutes the mirror. This casing is mounted on a rigid lattice structure 2 by means of connecting members 5. The reference point is 3, and in the case of FIG. 1 which relates to a rotational structure, it is the apex of mirror 1.

According to the invention, the member connecting the reference point 3 to the support is rigid in all directions, whereby this can be a spindle or a flange as shown in FIG. 1c, when an opening 6 is provided at the apex of the mirror, e.g. for permitting the passage of a supply guide of an ultra-high frequency source in the case of a radar. The connection at point 3 is totally rigid, so that under the action of stresses, it is necessary to prevent the mirror from turning onto itself with respect to this fixed point and also prevent it from being stressed at the other connecting points to be provided between the mirror and the support because otherwise the mirror would be deformed. However, according to the invention, the mirror must be able to expand in accordance with the radii of the surface of revolution. It should be noted that these expansions increase from the reference point. The connecting members to be provided, other than that fixed to the reference point are consequently flexible in the direction of the radii and rigid in the tangential direction and following the line perpendicular to the profile of the mirror.

Figure 2:
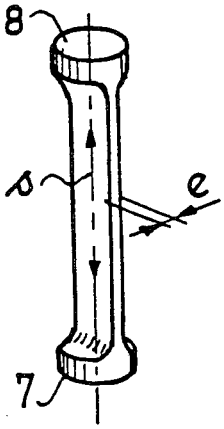
FIG. 2 a semi-rigid connecting member used according to the invention.

FIG. 2 shows a semi-rigid connecting member, which is able to satisfy the aforementioned conditions. This member is in the form of a flexible part s of limited thickness e compared with its length in a ratio which can be taken between 1:5 and 1:15. It is rigid along its axis and in the direction perpendicular to the axis and to the thickness. At its ends, the plate has two end fittings 7 and 8 enabling it to be fixed to the mirror and to the support at the considered point. Fixing can take place by mechanical fastening or by adhesion. The number of fixing points is dependent on the dimensions of the structure and the loads which it must be able to support.

Figure 3:
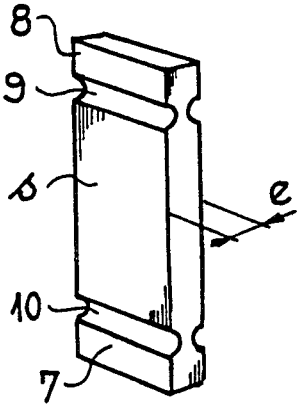
FIGS. 3 and 4 two other variants of a semi-rigid connecting member used according to the invention.

FIG. 3 gives another example of a semi-rigid plate 6, which is thicker than that of FIG. 2, i.e. its flexibility is less. However, in order to ensure an adequate flexibility a groove 9 and 10 is provided close to each of its ends.

Figure 4:
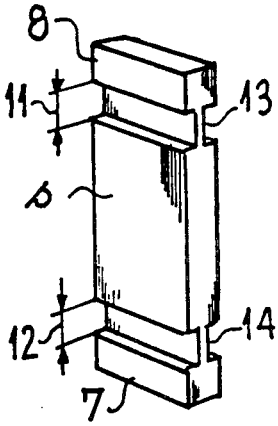

FIG. 4 shows a third example of a semi-rigid plate. The body of the plate, which is thicker than in the case of FIG. 2, has recesses 11 and 12 close to its ends so that all that is left of the plate is a tongue 13, 14 ensuring the degree of flexibility adequate for not preventing the expansion of the mirror at the considered point.

Figure 5:
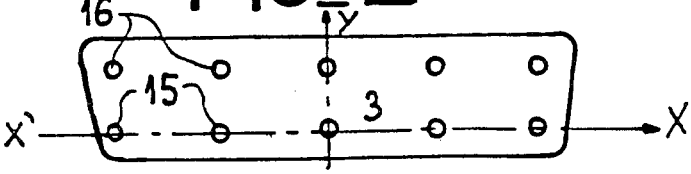
FIG. 5 a front view of an antenna structure having a plane of symmetry.
Figure 6:
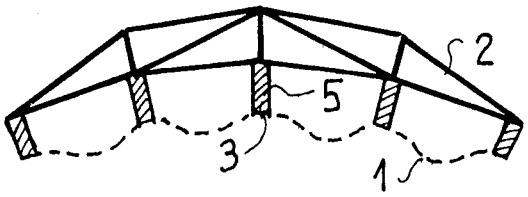
FIG. 6 a profile view of the structure of FIG. 5 showing the deformation of the mirror.

FIG. 5 is a front view of an antenna structure having a plane of symmetry, in this case a vertical plane OY. Points 15 and 16 are grouped in an arbitrary manner in two rows, whereof one is located in the OX plane perpendicular to the plane of symmetry OY passing through the reference point, are assumed to be associated with rigid connecting members. In this case, the expansion of the mirror is opposed and it deforms, in the manner shown in FIG. 6 showing the plan view the structure of FIG. 5. According to the invention, these deformations are eliminated when the connections, other than that associated with the reference point, are semi-rigid.

Figure 7:
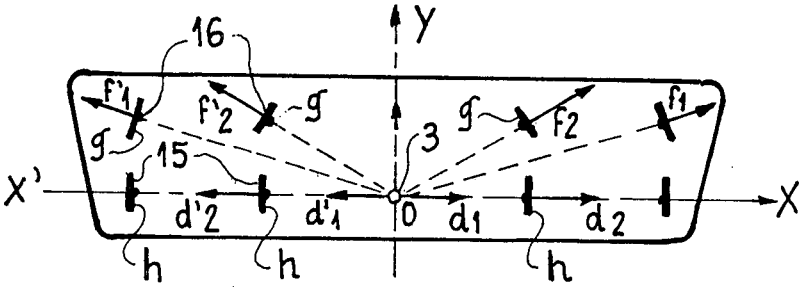
FIG. 7 a front view of an antenna structure with a plane of symmetry, equipped with connecting members according to the invention.

FIG. 7 is a front view of an antenna structure with a plane of symmetry, whose connecting members are in accordance with the invention. The point carrying reference numeral 3, which is also the origin of line OX is the reference point and the connecting member fixing it to the support is rigid in all directions, as would be the connecting member at this point in the case of a rotational structure. According to the invention, the other connections are flexible in at least one direction. In the plane OX perpendicular to the plane of symmetry at the reference points, it can be seen that the expansions start from the reference point and extend in direction X or X', as indicated by the arrows d1, d2, d'1, d'2. Thus, the connecting members (h) are flexible in these directions OX, OX' and the plates used are then arranged perpendicular to line XX' and will be rigid in direction OY and the line perpendicular to the profile of the mirror. It is pointed out that at the other considered points of e.g. row 16, expansion takes place in a direction connecting the reference point to the point in question, as is illustrated by the oriented segments f1, f2 . . . f'1, f'2. At these points, the connecting members g are flexible in at least one direction, i.e. in the plane tangential to the mirror at the considered point and rigid along the line perpendicular to this point to prevent the mirror from rotating. The orientation of the semi-rigid members g must be determined in an appropriate manner and is substantially perpendicular to the direction of the expansion at the considered point.

Figure 8:
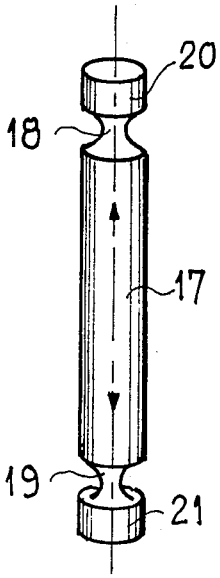
FIG. 8 a fourth variant of a connecting member according to the invention.

FIG. 8 shows another example of a connecting member which can more particularly be used at points 16 of a structure having a plane of symmetry. This member is constituted by a rod 17 having a groove 18, 19 at each of its ends leaving two fixing end fittings 20, 21. This rod is such that it has an adequate flexibility in flexion at its ends, whilst being rigid along its axis.

Thus, a description has been given of an antenna and more specifically of the fitting and fixing of a mirror to its rigid support. The antenna can be used with a radar or a telecommunications installation, including a space telecommunications installation.

What is claimed is:

1. An ultra-high frequency antenna, comprising:
a mirror;
a support structure for supporting said mirror, said mirror and support having different thermal expansion coefficients; and
connecting members joining said mirror and support; wherein
one connecting member positioned at a reference point is rigid in all directions, and the remaining connecting members are rigid in a first direction coinciding with the normal of the mirror at the point they join with the mirror and are flexible in at least a second direction which is perpendicular to the first, said second direction being along an expansion direction of the mirror which has a different expansion coefficient from that of the support structure with respect to the same expansion direction.

2. An ultra-high frequency antenna according to claim 1 wherein
for a curved structure, said reference point is the apex of the mirror, and
said remaining connecting members are flexible in said second direction which coincides with the radii of the circular structure.

3. An ultra-high frequency antenna according to claim 1, wherein
for a structure with a plane of symmetry, said reference point is the apex of a section in the mirror intersected by the plane of symmetry.

4. An ultra-high frequency antenna according to claim 3, wherein
the connecting members, other than those located in a plane perpendicular to the plane of symmetry, are flexible in the plane tangential to the mirror at the point they join the mirror, and rigid along a line perpendicular to said plane.

5. An antenna according to claim 1, wherein the connecting member at the reference point is a spindle or flange if the mirror has a hole at the reference point.

6. An antenna according to claim 1, wherein said remaining connecting members are flexible plates of limited thickness compared with its length and which are rigid along their axes and in the direction perpendicular to their axes and to the thickness, the ends of each such member having two end fittings for joining it to the mirror and to the structure.

7. An antenna according to claim 1, wherein said remaining connecting members are plates of relatively large thickness with grooves at their ends to attain the desired flexibility.

8. An antenna according to claim 1, wherein said remaining connecting members are plates having slots on their ends which form tongues to attain the desired flexibility.

9. An antenna according to claim 1, wherein said remaining connecting members are rods which are flexible by virtue of grooves at their ends to attain the desired flexibility.

10. An antenna according to claim 1, wherein said mirror comprises a metallized face of a laminated casing or shell, and said support comprises a metallic lattice joined to said casing by said remaining connecting members which are semi-rigid, except at said reference point where the connecting member is rigid in all directions.

11. A connecting member as in any one of claims 8, 9 or 10, wherein said connecting member is semi-rigid and connects two elements having substantially the same geometrical shape but different expansion coefficients.

* * * * *